US005803145A

United States Patent [19]

Lamb

[11] Patent Number: 5,803,145

[45] Date of Patent: Sep. 8, 1998

[54] STORM DOOR WITH OPERABLE WINDOW

[75] Inventor: Matthew C. Lamb, Omaha, Nebr.

[73] Assignee: Pacesetter Corp., Omaha, Nebr.

[21] Appl. No.: 867,206

[22] Filed: Jun. 2, 1997

[51] Int. Cl.[6] ..... A47H 3/00

[52] U.S. Cl. ..... 160/90; 160/371

[58] Field of Search ..... 160/371, 369, 160/379, 90, 91, 101, 190, 193, 37; 49/166, 445, 446, 447, 501

[56] References Cited

U.S. PATENT DOCUMENTS

| | | | |
|---|---|---|---|
| 3,489,199 | 1/1970 | Weikel et al. | 160/90 |
| 3,891,020 | 6/1975 | Mennuto | 160/90 X |
| 4,027,431 | 6/1977 | Rackard | 49/458 |
| 4,028,849 | 6/1977 | Anderson | 49/181 |
| 4,297,812 | 11/1981 | McPhail | 49/386 |
| 4,311,183 | 1/1982 | Herbst et al. | 160/90 X |
| 4,506,478 | 3/1985 | Anderson | 49/181 |
| 4,586,291 | 5/1986 | Swan | 49/501 |
| 4,599,833 | 7/1986 | Bullock | 52/127.5 |
| 4,667,441 | 5/1987 | Coddens | 49/404 |
| 4,685,175 | 8/1987 | Yonovich | 16/197 |
| 4,922,658 | 5/1990 | Coddens | 49/458 |
| 4,961,247 | 10/1990 | Leitzel et al. | 16/197 |
| 5,035,081 | 7/1991 | Yamamoto et al. | 49/161 |
| 5,265,308 | 11/1993 | May et al. | 16/197 |
| 5,634,508 | 6/1997 | Herbst | 160/371 |

*Primary Examiner*—David M. Purol

*Attorney, Agent, or Firm*—Zarley, McKee, Thomte, Voorhees & Sease; Mark D. Frederiksen

[57] ABSTRACT

A storm door includes a frame with opposing side rails, top and bottom rails, and a center mullion. A kick plate is mounted between the center mullion and bottom rail, and a stationary screen sash and stationary window panel are mounted within the same vertical plane between the center mullion and top rail. A window sash is slidably mounted between a pair of jamb liners on the side rails between the center mullion and top rail, and spaced inwardly of the screen sash and stationary window panel. Counterbalance assemblies are connected to the window sash and located between the jamb liners and side rails to permit retention of the window sash at any position between an upper position contacting the top rail, and the lower position contacting the center mullion.

14 Claims, 2 Drawing Sheets

STORM DOOR WITH OPERABLE WINDOW

TECHNICAL FIELD

The present invention relates generally to storm door and window assemblies, and more particularly to an improved storm door assembly with a single hung window sash with a counterweight balance assembly.

BACKGROUND OF THE INVENTION

The use of storm doors and windows has been popular for many years to provide reduced transmission of heat energy through door and window openings of houses. Many types of storm doors have been created, with varying degrees of effectiveness in terms of use as a thermal barrier.

While storm doors provide an additional layer of thermal protection, this thermal boundary is not always desired. For this reason, storm doors are typically readily removable or are provided with a window sash which may be replaced with a screen, or is slidably mounted over a screen sash to permit air to flow through the screen as desired.

The main problem with prior art storm doors having an operable sash lies in the fact that the sash typically has only three or four predetermined positions to which it may be opened and locked. In addition, the full weight of the sash must be lifted in order to open the sash to the desired height.

SUMMARY OF THE INVENTION

It is therefore a general object of the present invention to provide a storm door with an operable counterweighted single hung window.

Yet another object of the present invention is to provide a storm door with an operable window which may be opened to an infinite number of positions, and which is counterweighted to maintain the window in the selected open position.

Yet another object is to provide a storm door assembly which is economical to manufacture, simple to use, and refined in appearance.

These and other objects of the present invention will be apparent to those skilled in the art.

The storm door of the present invention includes a frame with opposing side rails, top and bottom rails, and a center mullion. A kick plate is mounted between the center mullion and bottom rail, and a stationary screen sash and stationary window panel are mounted within the same vertical plane between the center mullion and top rail. A window sash is slidably mounted between a pair of jamb liners on the side rails between the center mullion and top rail, and spaced inwardly of the screen sash and stationary window panel. Counterbalance assemblies are connected to the window sash and located between the jamb liners and side rails to permit retention of the window sash at any position between an upper position contacting the top rail, and the lower position contacting the center mullion.

DESCRIPTION OF THE PREFERRED EMBODIMENT

Figure 1:
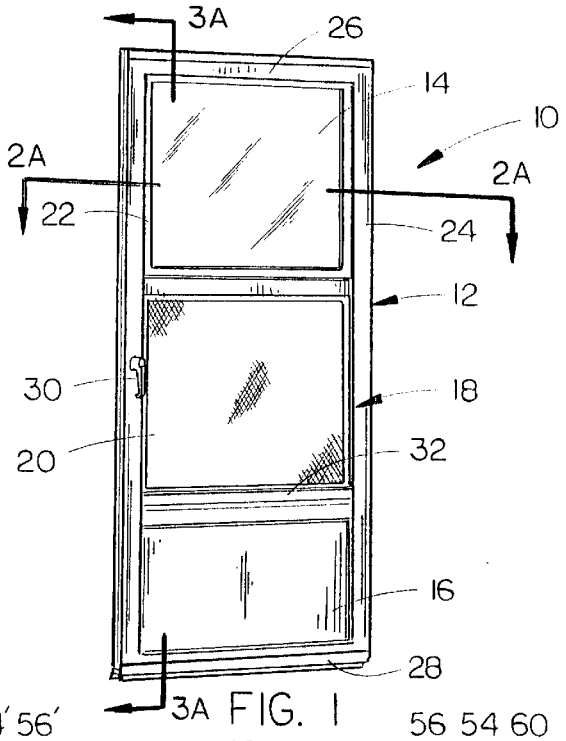
FIG. 1 is a perspective view of the storm door of the present invention.

Referring now to the drawings, in which similar or corresponding parts are identified with the same reference numeral and more particularly to FIG. 1, the storm door of the present invention is designated generally at 10 and includes a generally rectangular frame 12 which supports an upper lite 14, a lower panel 16, and the operable single hung sash, designated generally at 18. Sash 18 may be moved upwardly to reveal a stationary screen sash 20.

Storm door 10 includes a pair of opposed substantially parallel hollow side rails 22 and 24, a hollow top rail 26 and a hollow bottom rail 28. A conventional door handle and latch subassembly 30 is provided on side rail 24, and functions in a conventional manner to latch the door in a closed position. Side rail 22 forms the hinged side of storm door 10.

Figure 3A:
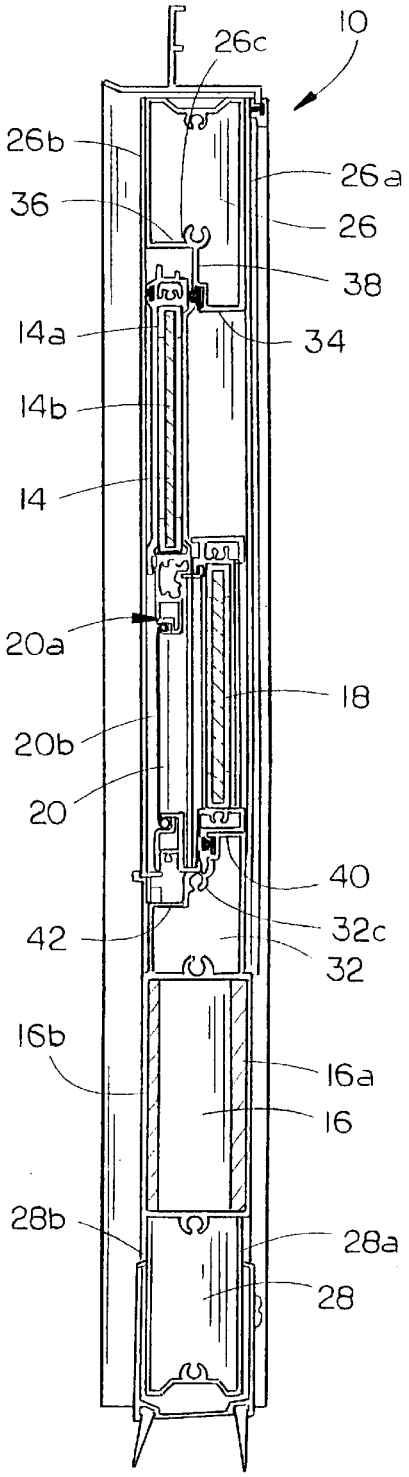
FIG. 3A is a sectional view taken at lines 3A—3A in FIG. 1.
Figure 3B:
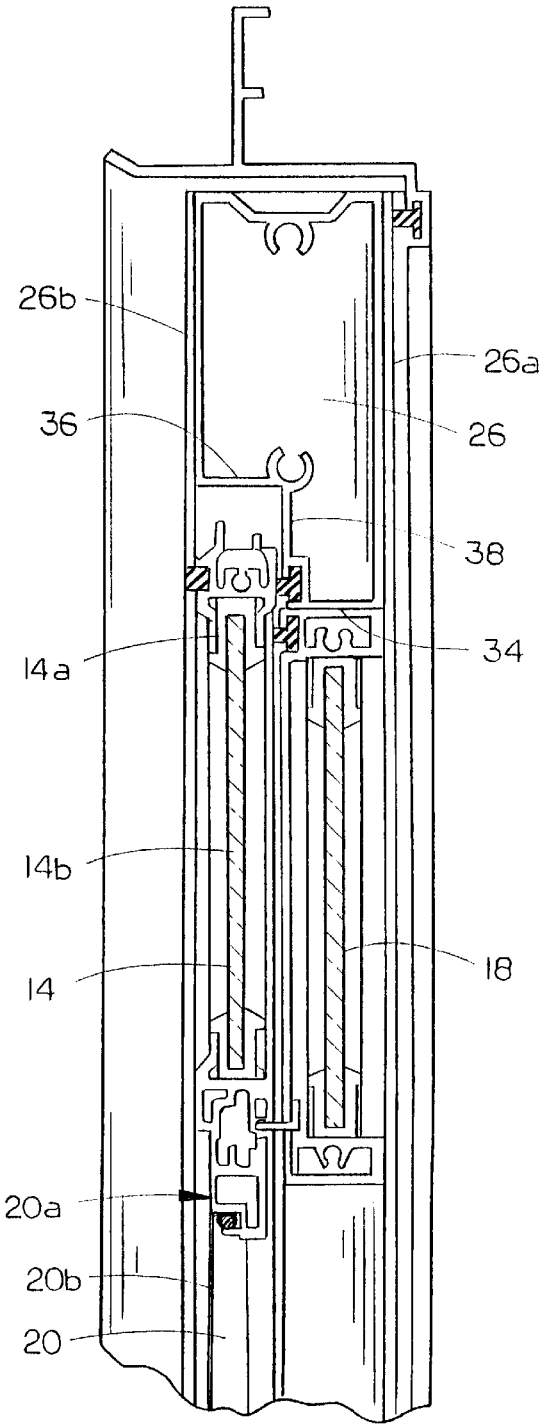
FIG. 3B is an enlarged view of a portion of FIG. 3A, with the operable sash in an open position.

Referring now to FIGS. 3A and 3B, it can be seen that the overall thickness of storm door 10 is about one inch or less, as measured from the interior faces 26*a* and 28*a* of top and bottom rails 26 and 28, to the exterior faces 26*b* and 28*b* of top and bottom rails 26 and 28. A center mullion 32 separates the lower panel 16 from the operable sash assembly 18, and extends between side rails 22 and 24, as shown in FIG. 1. Lower panel 16 is preferably hollow, with solid interior and exterior faces 16*a* and 16*b*. Obviously, lower panel 16 could also be a stationary screen panel or a stationary glass lite, or any other equivalent component.

Preferably, frame 12 is formed of an extrusion of aluminum or other metal, to achieve a lightweight yet strong structure.

Referring once again to FIGS. 3A and 3B, it can be seen that top rail 26 includes a stepped bottom surface 26*c* with an inward shoulder 34 depending downwardly below an outward shoulder 36 and connected by intermediate wall 38. Similarly, center mullion 32 includes an upper surface 32*c* formed of an inward shoulder 40 projecting upwardly beyond an outward shoulder 42 and connected by wall 44. Top rail inward shoulder 34 is vertically aligned with center mullion inward shoulder 40, and top rail outer shoulder 36 is vertically aligned with center mullion outward shoulder 42. As discussed in more detail hereinbelow, a stationary screen 20 and stationary lite 14 are mounted between top rail 26 and center mullion 32 and vertically aligned between the outward shoulders 36 and 42 of top rail 26 and center mullion 32.

Screen sash 20 includes a generally rectangular frame 20*a* with a screen 20*b* stretched across the frame. Similarly, lite 14 is of a conventional type having a frame 14*a* with a glass panel 14*b* mounted therein. While the preferred embodiment of the invention shows screen sash 20 mounted below lite 14, these two components could be exchanged with one another, such that the screen sash is in the upper portion of the storm door, rather than generally centered in the storm door.

Figure 2A:
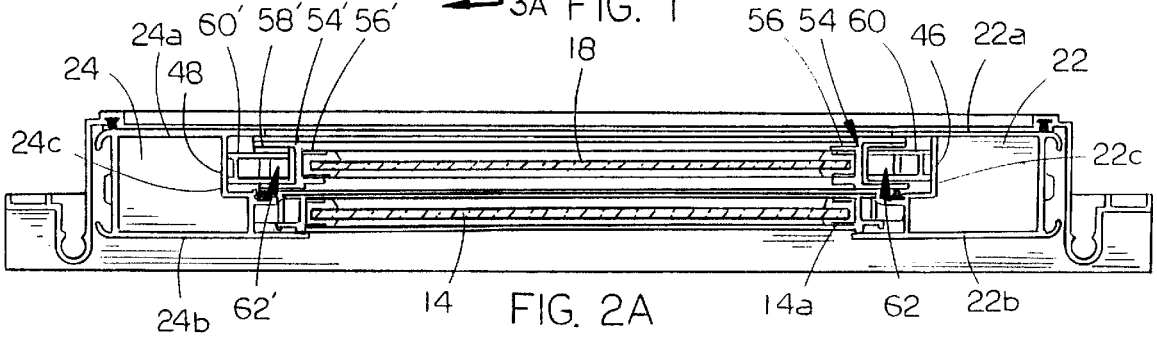
FIG. 2A is a sectional view taken at lines 2A—2A in FIG. 1.
Figure 2B:
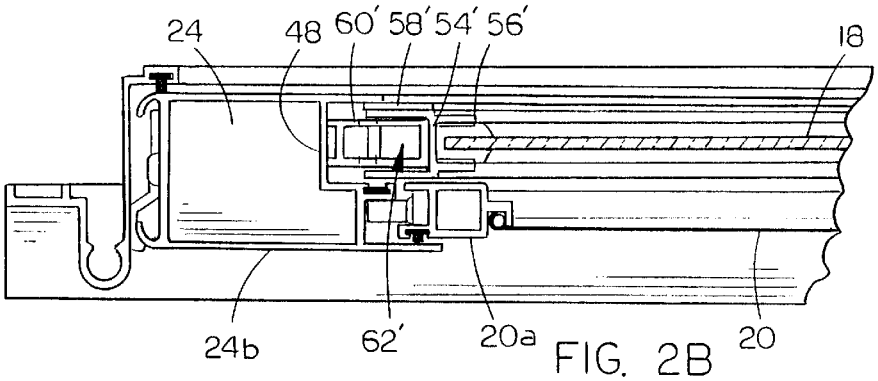
FIG. 2B is an enlarged view of a portion of FIG. 2A.

Referring now to FIGS. 2A and 2B, side rails 22 and 24 include inward and outward faces 22*a*, 24*a* and 22*b* and 24*b*, respectively. In addition, each of side rails 22 and 24 has an interior face 22*c* and 24*c*, respectively, which are directed towards one another and horizontally aligned. Side rail interior faces 22*c* and 24*c* each have an inward shoulder 46 and 48 respectively and an outward shoulder 50 and 52 respectively. Inward shoulders 46 and 48 are horizontally aligned and outward shoulders 50 and 52 are horizontally aligned, with inward shoulders 46 and 48 spaced apart a greater width than outward shoulders 50 and 52.

Screen sash 20 and upper lite 14 are mounted between outward shoulders 50 and 52, in alignment with the outward shoulders of top rail 26 and center mullion 32 (shown in FIG. 3A).

An elongated vertically extending jamb liner 54 includes a U-shaped guide track 56 which opens horizontally inwardly and an opposing U-shaped bracket 58 opening opposingly to guide track 56 to form a hollow chamber 60 between jamb liner 54 and side rail shoulder 46. A similar jamb liner 54' is mounted along side rail shoulder 48, with an inwardly directed U-shaped guide track 56' and an outwardly directed U-shaped bracket 58'. Guide tracks 56 and 56' slidably receive operable sash 18 therebetween. Hollow chambers 60 and 60' will house a conventional counterbalance assembly 62 and 62' operably connected to operable sash 18 in a conventional fashion. Counterbalance assemblies 62 and 62' may be of any known variety, including the older style pulley, weight and rope arrangement, or the more modem "constant force" spring arrangement. The critical feature of the counterbalance assemblies 62 and 62' is in the use of a balancing arrangement which will counter the weight of sash 18 to permit the user to position the sash at a desired opened height without requiring mechanical latching mechanisms to retain the sash at the desired height.

Whereas the invention has been shown and described in connection with the preferred embodiment thereof, many modifications, substitutions and additions may be made which are within the intended broad scope of the appended claims.

I claim:

1. A storm door comprising:

a frame including a pair of opposed, parallel, hollow side rails;

a hollow top rail extending between and interconnecting the side rails at upper ends thereof;

a hollow bottom rail extending between and interconnecting the side rails at lower ends thereof;

a hollow center mullion extending between the side rails, intermediate and parallel to the top and bottom rails;

a lower panel affixed between the center mullion and bottom rail, and between the side rails;

a screen sash resting atop the center mullion and extending between the side rails;

an upper panel resting atop the screen sash and extending between the side rails and up to the top rail;

a pair of jamb liners, one mounted along each side rail and extending from the center mullion to the top rail, each jamb liner shaped to form a vertically extending hollow chamber between the liner and the associated side rail;

a slidable window sash slidably mounted between said jamb liners on the side rails between a lower position resting on the center mullion and located adjacent the screen sash, and an upper position with an upper edge contacting the top rail and located adjacent the upper panel; and a pair of counterbalance assemblies, each assembly connected to the window sash and located substantially with in each hollow chamber, for counterbalancing the weight of the window sash to permit retention of the window sash at any position between the upper and lower positions.

2. The storm door of claim 1, wherein:

said storm door includes an inward face and an outward face;

each side rail includes an interiorly directed face to which said jamb liners, upper panel, lower panel, and screen sash are mounted; and said window sash is operably mounted in a vertical plane spaced inwardly of a vertical plane in which the upper panel and screen sash reside.

3. The storm door of claim 2, wherein the window sash and screen sash are substantially the same width and height, such that the window sash completely covers the screen sash when in the lower position.

4. The storm door of claim 3, wherein the side rail interiorly directed faces are stepped, each face including an inward shoulder and an outward shoulder, the rail inward shoulders being horizontally aligned, the outward shoulders being horizontally aligned, the outward shoulders being horizontally aligned, and the inward shoulders being spaced apart a distance greater than the outward shoulders;

said screen sash and upper panel being mounted between the outer shoulders, and said window sash being operably mounted between the inward shoulders.

5. The storm door of claim 4, wherein the upper panel is a transparent window panel.

6. The storm door of claim 5, wherein the lower panel is an opaque kick plate.

7. The storm door of claim 2, wherein the side rail interiorly directed faces are stepped, each face including an inward shoulder and an outward shoulder, the rail inward shoulders being horizontally aligned, the outward shoulders being horizontally aligned, the outward shoulders being horizontally aligned, and the inward shoulders being spaced apart a distance greater than the outward shoulders;

said screen sash and upper panel being mounted between the outer shoulders, and said window sash being operably mounted between the inward shoulders.

8. A storm door, comprising:

a frame including a pair of opposed, parallel, hollow side rails;

a hollow top rail extending between and interconnecting the side rails at upper ends thereof;

a hollow bottom rail extending between and interconnecting the side rails at lower ends thereof;

a hollow center mullion extending between the side rails, intermediate and parallel to the top and bottom rails;

a lower panel affixed between the center mullion and bottom rail, and between the side rails;

an upper panel resting atop the center mullion and extending between the side rails;

a screen sash resting atop the upper panel and extending between the side rails and up to the top rail;

a pair of jamb liners, one mounted along each side rail and extending from the center mullion to the top rail, each jamb liner shaped to form a vertically extending hollow chamber between the liner and the associated side rail;

a slidable window sash slidably mounted between the jamb liners and the side rails, between a lower position resting on the center mullion and located adjacent the upper panel, in an upper position with an upper edge contacting a top rail, with the window sash located adjacent the screen sash; and a pair of counterbalance assemblies, each assembly connected to the window sash and located substantially within each hollow chamber, for counterbalancing the weight of the window sash to permit retention of the window sash at any position between the upper and lower positions.

9. The storm door of claim 8, wherein:

said storm door includes an inward face and an outward face;

each side rail includes an interiorly directed face to which said jamb liners, upper panel, lower panel, and screen sash are mounted; and said window sash is operably mounted in a vertical plane spaced inwardly of a vertical plane in which the upper panel and screen sash reside.

10. The storm door of claim 9, wherein the window sash and screen sash are substantially the same width and height, such that the window sash completely covers the screen sash when in the lower position.

11. The storm door of claim 10, wherein the side rail interiorly directed faces are stepped, each face including an inward shoulder and an outward shoulder, the rail inward shoulders being horizontally aligned, the outward shoulders being horizontally aligned, the outward shoulders being horizontally aligned, and the inward shoulders being spaced apart a distance greater than the outward shoulders;

said screen sash and upper panel being mounted between the outer shoulders, and said window sash being operably mounted between the inward shoulders.

12. The storm door of claim 11, wherein the upper panel is a transparent window panel.

13. The storm door of claim 12, wherein the lower panel is an opaque kick plate.

14. The storm door of claim 9, wherein the side rail interiorly directed faces are stepped, each face including an inward shoulder and an outward shoulder, the rail inward shoulders being horizontally aligned, the outward shoulders being horizontally aligned, the outward shoulders being horizontally aligned, and the inward shoulders being spaced apart a distance greater than the outward shoulders;

said screen sash and upper panel being mounted between the outer shoulders, and said window sash being operably mounted between the inward shoulders.

* * * * *